US006802818B2

(12) United States Patent
Wang et al.

(10) Patent No.: US 6,802,818 B2
(45) Date of Patent: Oct. 12, 2004

(54) MULTI-FUNCTIONAL MASSAGE DEVICE

(76) Inventors: Kuan Yun Wang, No. 3, Lane 414, Sec. 2, An Kang Rd., Hsintien City, Taipei Hsien (TW); Hon-Shen Chew, No. 4-3, Lane 40, Chu Kuang Rd., Pan Chiao City, Taipei Hsien (TW); Wei Lin Chen, No. 12, Fu An Hsin Tsun, Ta Hsi Jen, Tao Yuan Hsien (TW)

( * ) Notice: Subject to any disclaimer, the term of this patent is extended or adjusted under 35 U.S.C. 154(b) by 160 days.

(21) Appl. No.: 10/300,780

(22) Filed: Nov. 21, 2002

(65) Prior Publication Data

US 2004/0102725 A1 May 27, 2004

(51) Int. Cl.[7] ..... A61H 23/02; B43K 29/00

(52) U.S. Cl. ..... 601/72; 601/80; 401/195

(58) Field of Search ..... 601/46, 67, 69, 601/70, 72, 80, 81, 82, 141, 142; 401/52, 109, 195; 362/118

(56) References Cited

U.S. PATENT DOCUMENTS 5,165,814 A * 11/1992 Buda ..... 601/80
5,244,299 A * 9/1993 Chu ..... 401/195
5,688,063 A * 11/1997 Yu et al. ..... 601/72
6,037,078 A * 3/2000 Siu-Man ..... 601/70
6,213,961 B1 * 4/2001 Reinsma ..... 601/80
6,604,880 B1 * 8/2003 Huang et al. ..... 401/195

* cited by examiner

*Primary Examiner*—Nicholas D. Lucchesi
*Assistant Examiner*—Quang D Thanh
(74) *Attorney, Agent, or Firm*—Browdy and Neimark, P.L.L.C.

(57) ABSTRACT

A multi-functional massage device has an accommodating body, an actuating element located above the accommodating body, and a casing. A vibration motor is arranged in the accommodating body. A conductive column electrically connected to one electrode of the vibration motor is formed on a top of the accommodating body. The actuating element has a collar, a cap, a ring, and a conductive spring. One open end of the collar receives the cap. A ring is formed at a lower portion of the actuating element. A conductive spring is mounted between the column and the ring. The casing receives the accommodating body, the ring, the conductive spring, and a battery that is electrically connected to another electrode of the motor. The protrusion, the top of the conductive spring, and the conductive column are aligned with one another. The battery is further electrically connected to the casing.

10 Claims, 7 Drawing Sheets

MULTI-FUNCTIONAL MASSAGE DEVICE

BACKGROUND OF THE INVENTION

1. Field of the Invention

The invention relates to a multi-functional massage device. More specifically, the invention relates to a multi-functional massage device that does not easily deform nor is damaged due to external shocks, which prevents short circuit or failure and provides a better quality and a more durable service life.

2. Description of the Related Art

In the modern lifestyle, people do not regularly practice physical exercise. Due to this lack of physical exercise, a person may suffer various types of physical pains in different parts of the body. A massage pen is a conventional means of conveniently providing a massage function to relieve these physical pains.

As illustrated in FIG. 2, the massage device A includes an accommodating body 1, a switch 2, and a casing 3. The accommodating body 1 is placed inside the casing 3. A button 31 penetrates through a top of the casing 3. A vibration motor 11 having an eccentric cam 113 is mounted inside the accommodating body 1. The switch 2 is mounted on the accommodating body 1. One electrode 111 of the vibration motor 11 is electrically connected to a battery 32. Another electrode 112 of the vibration motor 11 is electrically connected to the switch 2 by a wire. The battery 32 is electrically connected to the electrode 111 and the casing 3 to connect/disconnect an electric loop of the vibration motor 11 by operation of the switch 2. When a user presses the button 31 against a part of his body, the button 31 pushes against the switch 2 to activate the vibration motor 11.

On an inner bottom of the switch 2, two disconnected electrodes 23, 24 are formed. A pressing portion 21 having a protuberance 211 on a bottom thereof is formed through a top of the switch 2. A bent metal film 22 that provides a resilient force is located under the pressing portion 21. The pressing portion 21 is flattened by action of the protuberance 211 when the metal film 22 is pressed down. The electrodes 23, 24 are thereby electrically connected.

Electrically connecting the electrodes 23, 24 is determined by the operation of the bent metal film 22. When the massage device A or a pen combined with the massage device A accidentally drops or when an excessive external force is exerted thereon, the metal film 22 easily deforms or is damaged, which reduces the quality of the product.

Furthermore, a commercial massage product, such as a massage pen, usually cannot be further combined with another product, such as a key ring or pointer. Therefore, there is a need to provide a massage device that can overcome the above disadvantages.

SUMMARY OF THE INVENTION

It is therefore a principal object of the invention to provide a multi-functional massage device that does not easily deform nor is damaged due to external shocks, which prevents short circuit or failure, and has an improved quality and a more durable service life.

It is another object of the invention to provide a multi-functional massage device that can be externally connected to a portable device such as a pen, a pointer, a marker pen, a key ring or a perfume pen to provide more operating functions in addition to massage.

To accomplish the above and other objectives, a multi-functional massage device is provided. The multi-functional massage device comprises an accommodating body, an actuating element located above the accommodating body, and a casing. A vibration motor is installed in the accommodating body. A conductive column electrically connected to one electrode of the vibration motor is formed on a top of the accommodating body. The actuating element comprises a collar, a cap, a ring, and a conductive spring. One open end of the collar receives the cap. The ring is formed at a lower portion of the actuating element. The conductive spring is mounted between the protrusion and the ring. The casing respectively receives the accommodating body, the ring, the conductive spring, and a battery that is electrically connected to another electrode of the motor. The protrusion, the top of the conductive spring, and the conductive column are aligned with one another. The battery is further electrically connected to the casing.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows.

DETAILED DESCRIPTION OF THE EMBODIMENTS

Figure 1:
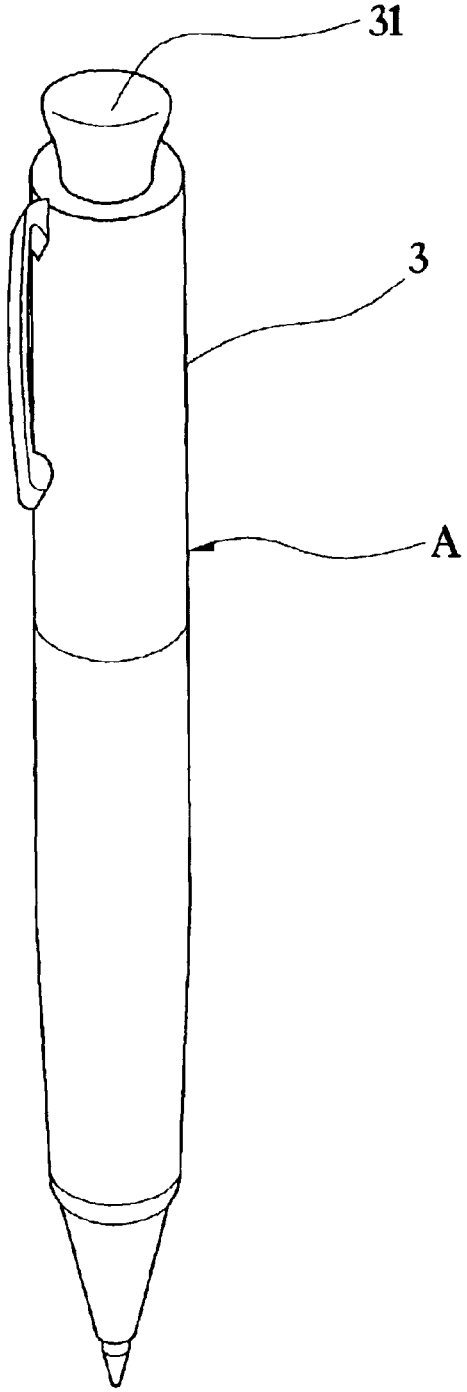
FIG. 1 PRIOR ART
FIG. 1 is a perspective view of a conventional massage pen.
Figure 2:
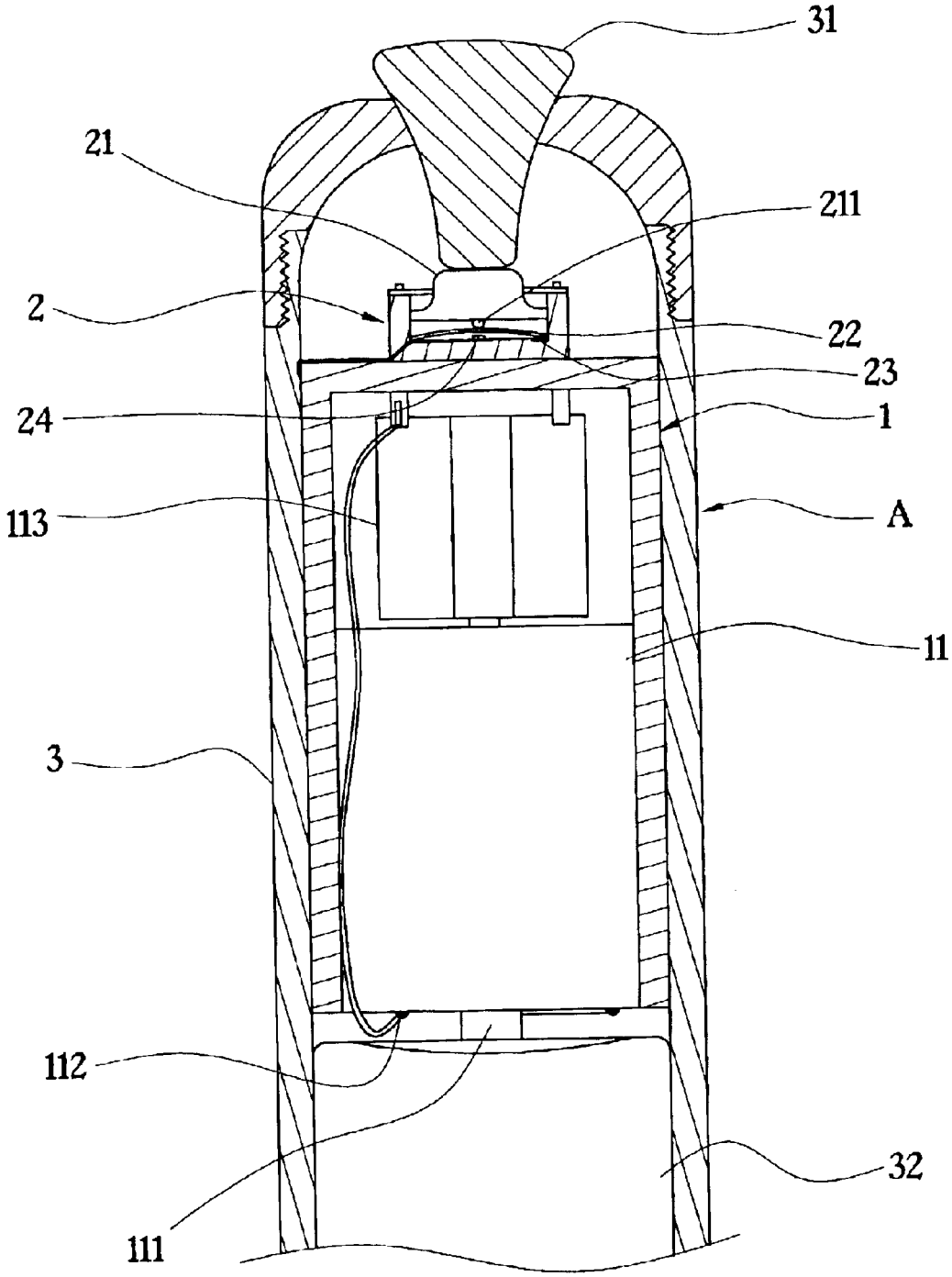
FIG. 2 PRIOR ART
FIG. 2 is a sectional view of a conventional massage pen.

Wherever possible in the following description, like reference numerals will refer to like elements and parts unless otherwise illustrated.

Figure 3:
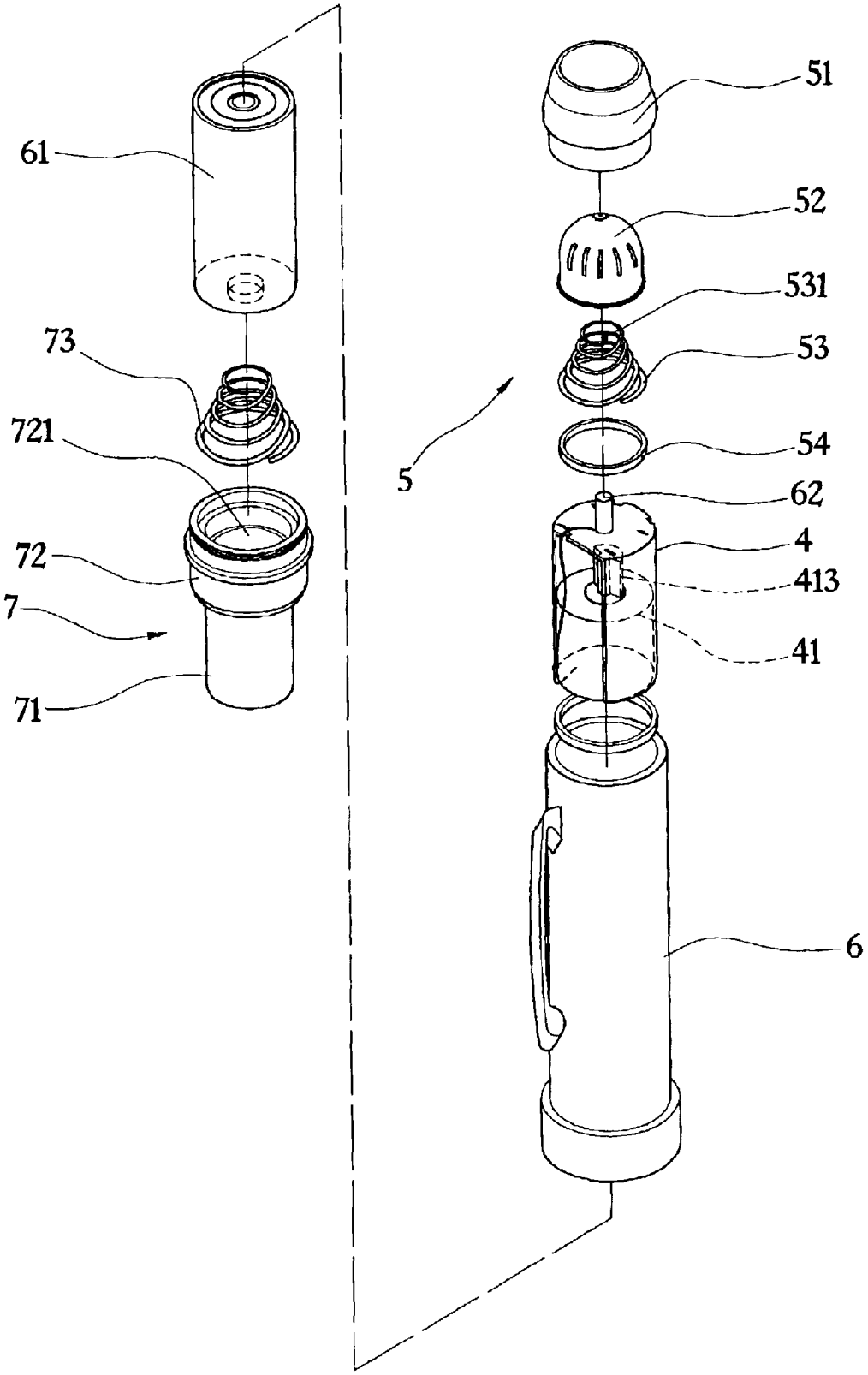
FIG. 3 is an exploded view of a massage device according to an embodiment of the invention.
Figure 4:
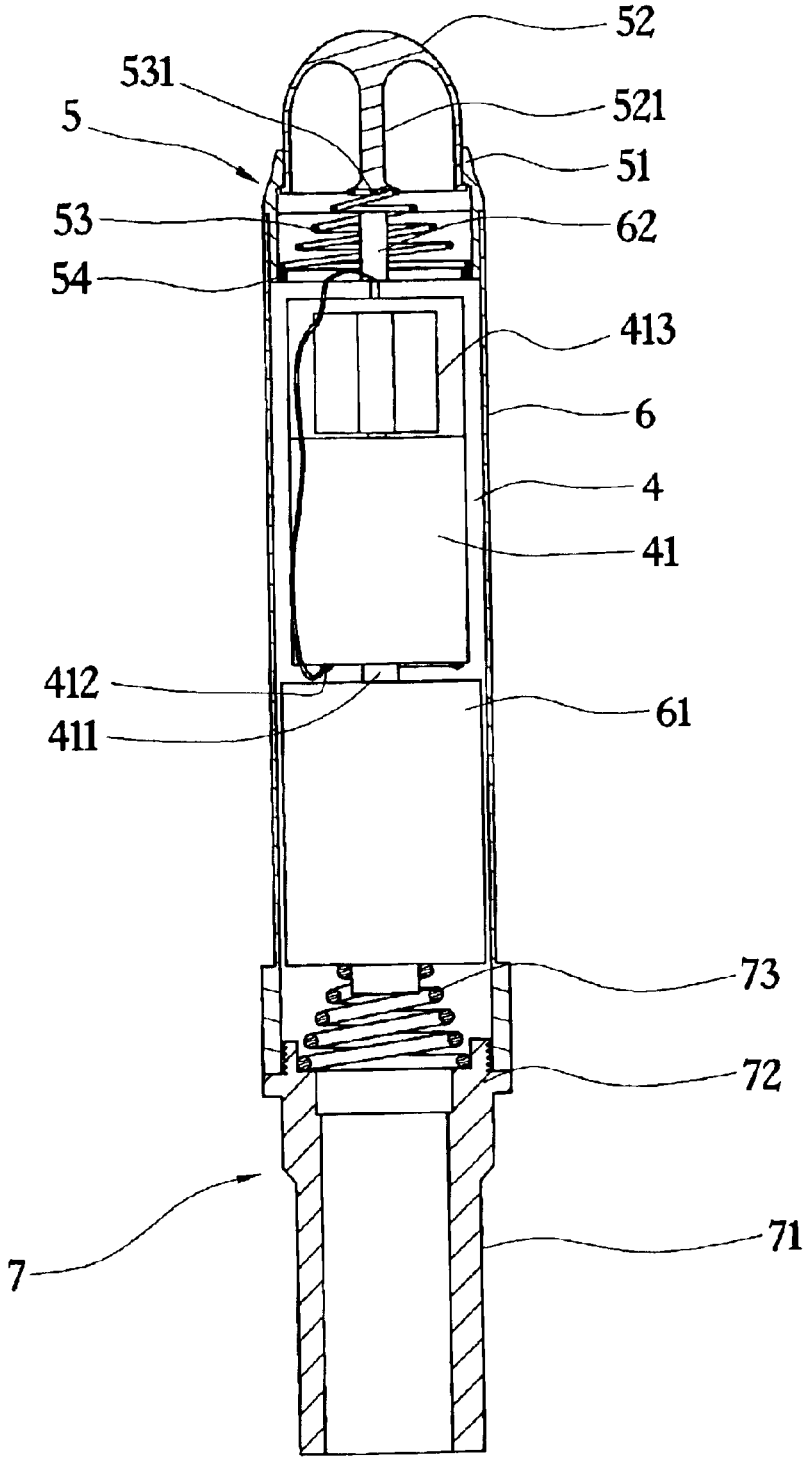
FIG. 4 is a cross-sectional view of a massage device before operation according to an embodiment of the invention.

FIG. 3 is an exploded view of a massage device according to one embodiment of the invention. FIG. 4 is a cross-sectional view of a massage device according to one embodiment of the invention. As illustrated, a massage device of the invention includes an accommodating body 4, an actuating element 5, and a casing 6.

The accommodating body 4 includes an eccentric cam 413 connected to a vibration motor 41. Two electrodes 411, 412 are formed at a bottom of the vibration motor 41.

The actuating element 5 includes a collar 51, a cap 52, a conductive spring 53, and a ring 54. The collar 51 has two open ends one of which receives the cap 52. A protrusion 521, as illustrated in FIG. 4, downwardly extends from a top inner portion of the cap 52. The ring 54 engages with an inner bottom of the collar 51. The conductive spring 53 has, for example, a cone shape. The conductive spring 53 is movably mounted between the protrusion 521 and the ring 54. A conductor 531 is further pressed against the protrusion 521 by the conductive spring 53.

A conductive column 62 is formed on the accommodating body 4 and is electrically connected to one of the electrodes 412 of the vibration motor 41 via a wire. The electric connection of the conductive column 62 to the electrode 412 is achieved by placing a bare portion of the wire at a location of the conductive column 62. Other electrical connection methods such as welding the wire to the conductive column 62 may also be used.

A battery 61 is located inside the casing 61 under the accommodating body 4. A negative electrode is electrically connected to a motor electrode 41. The collar 51 is located on a top of the casing 6. The conductive column 62 on the accommodating body 4 is inserted in the conductive spring 53. Before the cap 52 is pressed, the conductive column 62 is disconnected from the conductor 531 to open the electric loop of the massage device. The operation of the massage device is controlled via operating the cap 52 of the actuating element 5. The protrusion 521, the conductor 531, and the conductive column 62 are aligned with one another.

Figure 5:
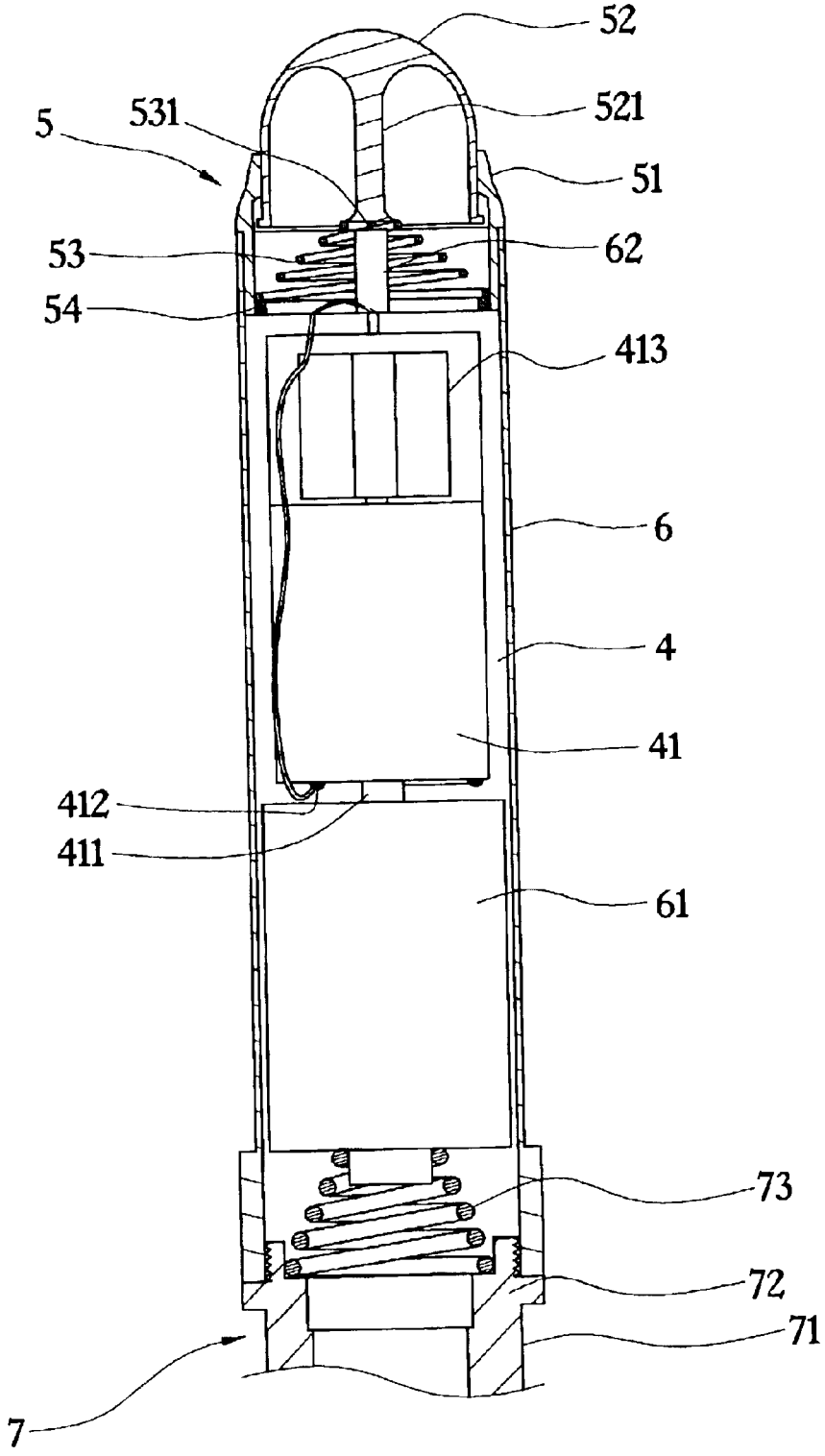
FIG. 5 is a cross-sectional view of a massage device in operation according to an embodiment of the invention.

Referring to FIG. 4 and FIG. 5, when the cap 52 is pressed down, the protrusion 521 presses down the conductive spring 53 so that conductive spring 53 contacts the conductive column 62 and the electrode 412 of the vibration motor 41 connects the electric loop of the massage device. The vibration motor 41 is thereby activated.

A connecting body 7 further includes a first connecting portion 71 and a second connecting portion 72 that define a space 721. Second threads are formed on an external surface of the second connecting portion 72. First threads that engage with the second threads are formed on an inner surface at a lower portion of the casing 6. A conductive spring 73 is arranged in the space 721 to electrically connect a positive electrode of the battery 61, so that the battery 61 is electrically connected to one electrode 411 of the vibration motor 41.

Figure 6:
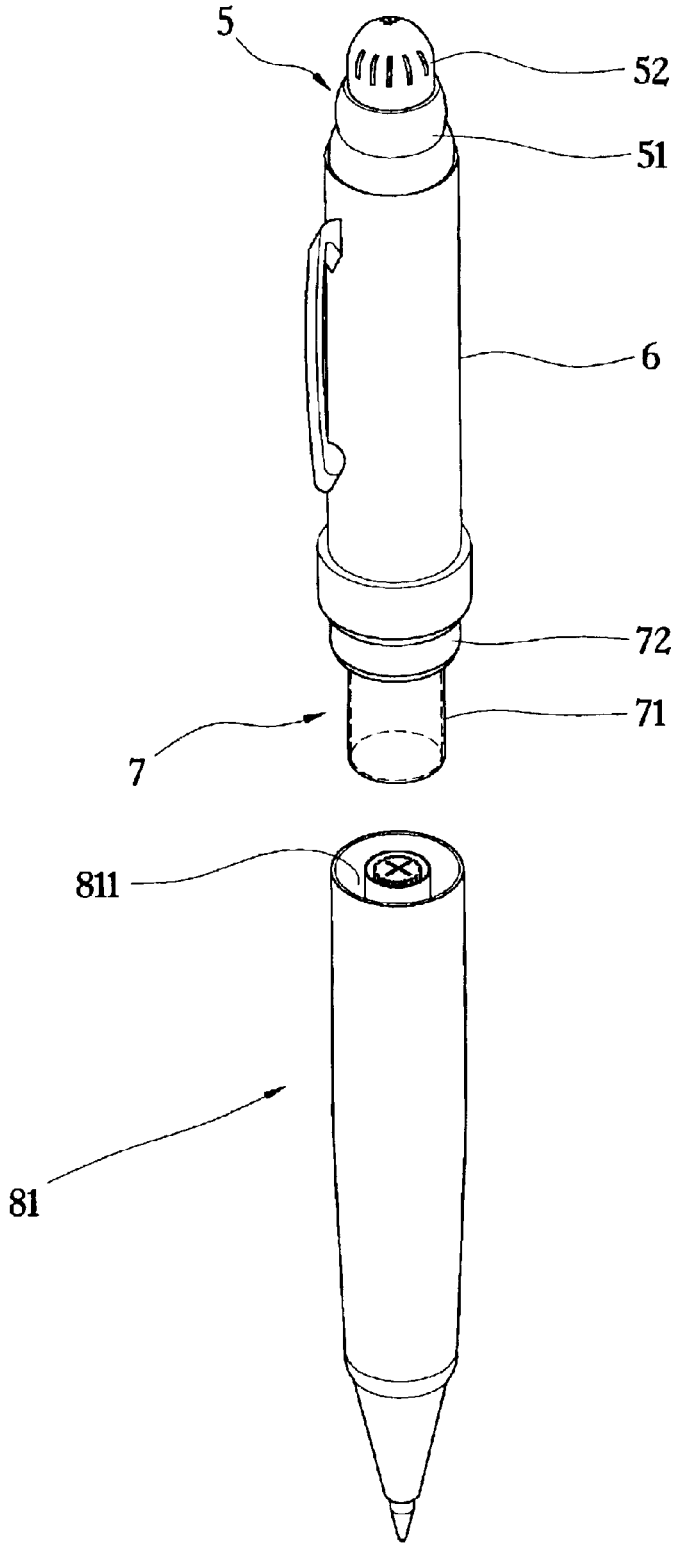
FIG. 6 is a perspective view of a massage device combined with an external device according to another embodiment of the invention.
Figure 7:
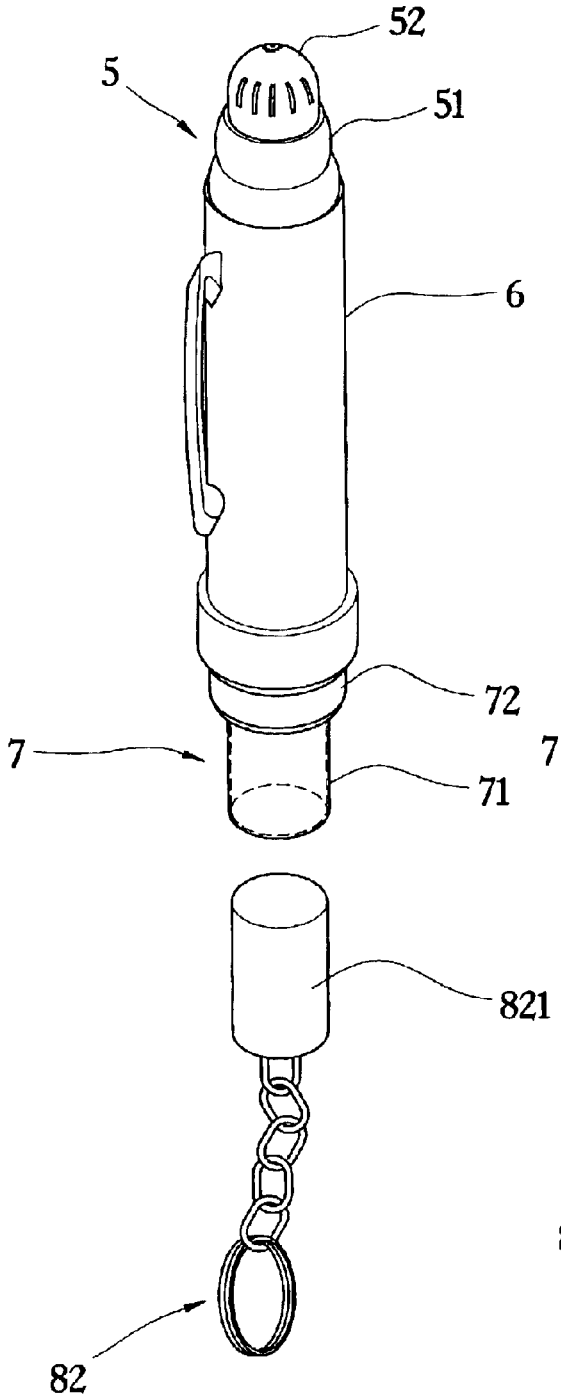
FIG. 7 is a perspective view of a massage device combined with an external device according to yet another embodiment of the invention.
Figure 8:
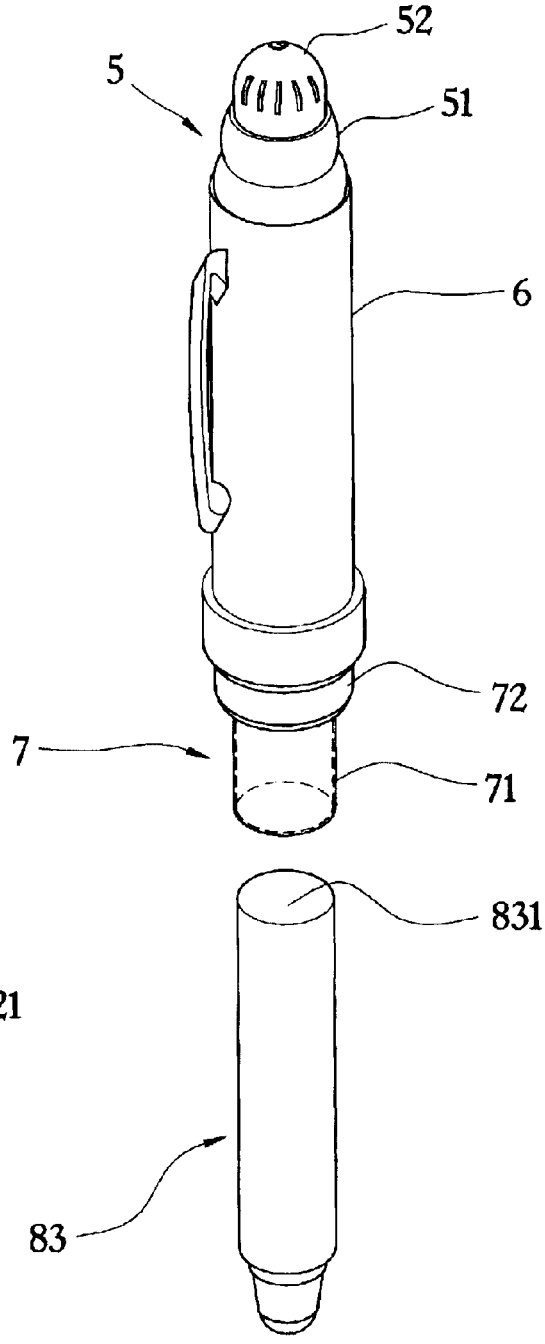
FIG. 8 is perspective view of a massage device combined with an external device according to a further embodiment of the invention.

Referring to FIG. 3, FIG. 4 and FIG. 6, the connecting body 7 engages with the lower portion of the casing 6 of the massage device. The first connecting portion 71 is used to externally connect other devices. As illustrated in FIG. 6, a connecting portion 811 of an external device 81 is inserted into the first connecting portion 71 of the connecting body 7 of the massage device. An example of the external device 81 includes a pen, a pointer or marker pen. FIG. 7 illustrates another embodiment of the invention in which a connecting portion 821 of a key ring 82 is inserted into the connecting body 7 of the massage device. FIG. 8 illustrates yet another embodiment of the invention in which a connecting portion 831 of a perfume pen 83 is inserted into the connecting body 7 of the massage device. By means of the connecting body 7, the massage device of the invention can be therefore combined with an external device to provide other functions in addition to massage functions.

Since the actuating element 5 is not easily deformed or damaged by shocks, which may cause short circuit or failure, the quality of the massage device is therefore improved, and a more durable service life of the massage device is ensured. Furthermore, the massage device of the invention can be externally connected to a portable device such as a pen, a pointer, a marker pen, a key ring or a perfume pen to provide other functions in addition to massage.

Those skilled in the art will readily appreciate that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A multi-functional massage device, comprising:

an accommodating body, a vibration motor being installed therein, a conductive column electrically connected to a first electrode of the vibration motor, the conductive column being formed on a top of the accommodating body;

an actuating element, located above the accommodating body and including:

a collar, having two open ends;

a cap, having a downwardly extending protrusion therein, one open end of the collar receiving the cap;

a ring, formed at a lower portion of the actuating element; and a conductive spring, mounted between the protrusion and the ring; and a casing, respectively receiving the accommodating body, the ring, the conductive spring, and a battery electrically connected to a second electrode of the motor, wherein the protrusion, a top of the conductive spring and the conductive column are aligned with one another, and the battery is further electrically connected to the casing.

2. The multi-functional massage device of claim 1, further comprising a connecting body that has a first connecting portion, another conductive spring being located inside the first connecting portion to electrically connect the battery.

3. The multi-functional massage device of claim 1, further comprising a connecting body that has a first connecting portion and a second connecting portion below the first connecting portion, a connecting portion of an external device being connected to the first connecting portion of the connecting body.

4. The multi-functional massage device of claim 3, wherein the external device is a pen, a pointer, or a marker pen.

5. The multi-functional massage device of claim 3, wherein the external device is a key ring.

6. The multi-functional massage device of claim 3, wherein the external device is a perfume pen.

7. The multi-functional massage device of claim 3, wherein the first connecting portion of the connecting body is inserted into the connecting portion of an external device.

8. The multi-functional massage device of claim 3, wherein the first connecting portion of the connecting body receives the connecting portion of the external device.

9. The multi-functional massage device of claim 1, further comprising a conductor.

10. A multi-functional massage device, comprising:

a casing;

a conductive column, located inside the casing;

a vibration motor, placed inside the casing, the vibration motor having two electrodes, wherein one electrode is electrically connected to the conductive column;

a conductive spring, mounted above the conductive column and the vibration motor, the conductive spring having a conductor on a top thereof;

a cap, fitted in a top of the casing and having a protrusion thereon, the protrusion being pressed against the conductor of the conductive spring, the protrusion and the conductor and the conductive column being aligned with one another; and a battery, located inside the casing to connect electrically another electrode of the vibration motor.

* * * * *